US006296516B1

(12) United States Patent
Kuo et al.

(10) Patent No.: US 6,296,516 B1
(45) Date of Patent: Oct. 2, 2001

(54) CABLE CONNECTOR HAVING DEVICE FOR ANCHORING A CABLE AT AN ANGLED POSITION

(75) Inventors: Chin Pao Kuo, Taipei; Peter Kuo, Chung-Ho, both of (TW)

(73) Assignee: Hon Hai Precision Ind. Co., Ltd., Taipei Hsein (TW)

( * ) Notice: Subject to any disclaimer, the term of this patent is extended or adjusted under 35 U.S.C. 154(b) by 0 days.

(21) Appl. No.: 09/491,352

(22) Filed: Jan. 26, 2000

(30) Foreign Application Priority Data

Dec. 17, 1999 (TW) ..... 88221561

(51) Int. Cl.[7] ..... H01R 13/58
(52) U.S. Cl. ..... 439/459
(58) Field of Search ..... 439/459, 456, 439/457

(56) References Cited

U.S. PATENT DOCUMENTS 3,622,943 * 11/1971 Reimer ..... 439/472
3,794,960 * 2/1974 Sugar ..... 439/459
4,592,612 * 6/1986 Kikuta ..... 439/610

* cited by examiner

*Primary Examiner*—Brian Sircus
*Assistant Examiner*—Brian S. Webb
(74) *Attorney, Agent, or Firm*—Wei Te Chung

(57) ABSTRACT

A cable connector of the present invention comprises a rectangular dielectric housing (11), an angled cable (30) and a fastening member (20). A pair of mounting wings (12) is integrally extended from opposite side walls (113) of the housing. A receiving channel (115) is longitudinally defined in the housing for receiving the cable. A pair of slots (116) is defined in the housing beside the receiving channel, and a recessed section (117) laterally extends from an end of the each slot. The fastening member includes a pair of side beams (21) received in the slots of the housing and an intermediate beam (22) between the side beams for pressing against the cable. Each side beams has a distal end (212) pointing away from the intermediate beam for latching within the corresponding recessed sections of the housing.

6 Claims, 4 Drawing Sheets

CABLE CONNECTOR HAVING DEVICE FOR ANCHORING A CABLE AT AN ANGLED POSITION

BACKGROUND OF THE INVENTION

The present invention relates to a cable connector, and more particularly to a cable connector which has a device for reliably anchoring a cable of the connector at an angled position.

A cable of a cable connector is often required to be bent to an angle under a particular circumstance. The usual method, which presently exists, is to apply glue to retain the bent cable in position. The use of glue needs an extended assembly time since it takes time for the glue to cure. Furthermore, the glue causes an unsatisfactory appearance. Finally, the glue may contaminate the connector when the glue is carelessly applied to the connector. To overcome aforementioned drawbacks, Taiwan patent application No. 77210069 disclosed a cable connector 1', as shown in FIG. 4, which can fix a cable 3' at an angled position. In order to fix the cable 3' in the connector 1' at an angled position, a semicircle metallic retainer 5' is used having two opposite apertures 51' on both sides thereof for extension of screws 4' to clamp the cable 3' at the given angled position. A plurality of wires 31 of the cable 3' are extended into the connector to connect with terminals (not shown) of the connector. The conventional connector can fix a cable at the angled position, but the use of the metallic retainer 5' and the screws 51' is cost and not convenient. Hence, an improved device for anchoring a cable of a cable connector at an angled position is required to overcome the disadvantages of the prior arts.

BRIEF SUMMARY OF THE INVENTION

A main object of the present invention is to provide a cable connector having means for orienting a cable at a desired position and anchoring the cable at a particular angle.

Another object of the present invention is to provide a cable connector which can be conveniently manufactured and has a favorable appearance.

A cable connector according to the present invention comprises a dielectric housing, a fastening member and a flexible cable having an end extending into the housing. A pair of mounting wings are integrally extended from opposite side walls of the housing. A receiving channel is longitudinally defined in the housing. A pair of slots are defined in the housing beside the channel, and a recessed section laterally extends from an end of each slot of the housing. The fastening member is adapted to anchor the cable at substantially a right angle and includes a pair of side beams received in the slots of the housing and an intermediate beam between the side beams for pressing against the cable. Each side beam of the fastening member has a distal end pointing away from the intermediate beam and latching within the corresponding recessed section of the housing.

Other objects, advantages and novel features of the invention will become more apparent from the following detailed description when taken in conjunction with the accompanying drawings.

DETAILED DESCRIPTION OF THE INVENTION

Figure 1:
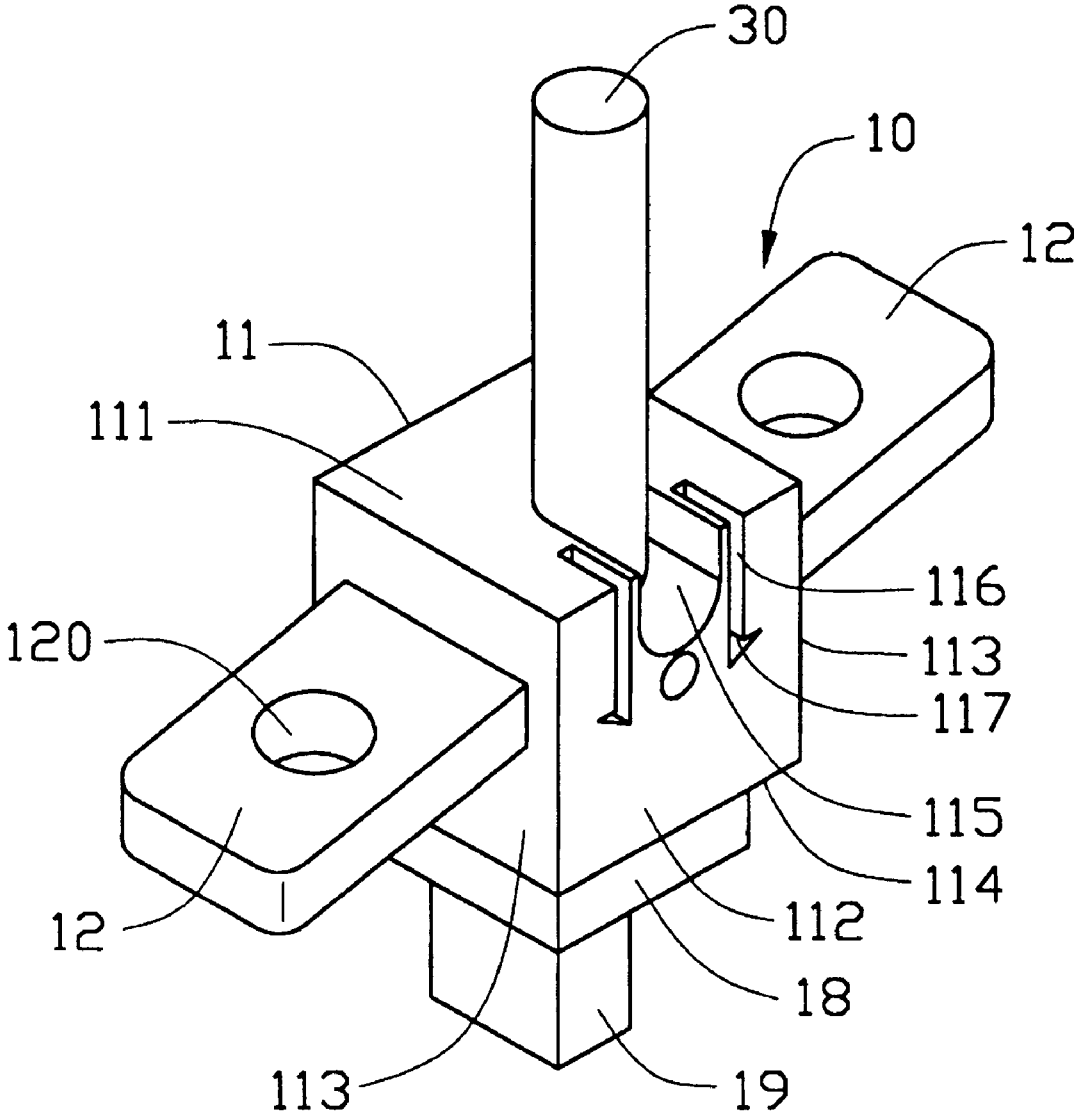
FIG. 1 is a perspective view of a cable connector according to the present invention before a cable thereof is bent.

Referring to FIG. 1, a cable connector 10 in accordance with the present invention comprises a dielectric housing 11, a metallic shell 18 extending out of the housing 11, a plug portion 19 extending out of the shell 18 for mating with a complementary connector (not shown), a fastening member and a flexible cable 30 having an end extending into the housing 11 to electrically connect with terminals (not shown) in the housing 11. A pair of mounting wings 12 are integrally extended from opposite side walls 113 of the housing 11. The housing 11 is substantially rectangular and includes a front wall 111, a top wall 112 and the side walls 113. A receiving channel 115 has generally a semicircular cross section for fitting the cable 30 therein and is longitudinally defined in the top wall 112 extending from a middle portion thereof towards the front wall 111. A pair of slots 116 are defined in the front wall 112 of the housing 11 beside the channel 115. A triangular recessed section 117 laterally extends from a lower end of each slot 116. The slots 116 and recessed sections 117 depress toward a rear wall 114 opposite the front wall 111 depth. Furthermore the slots 116 are exposed to the top of the housing 11.

Figure 2:
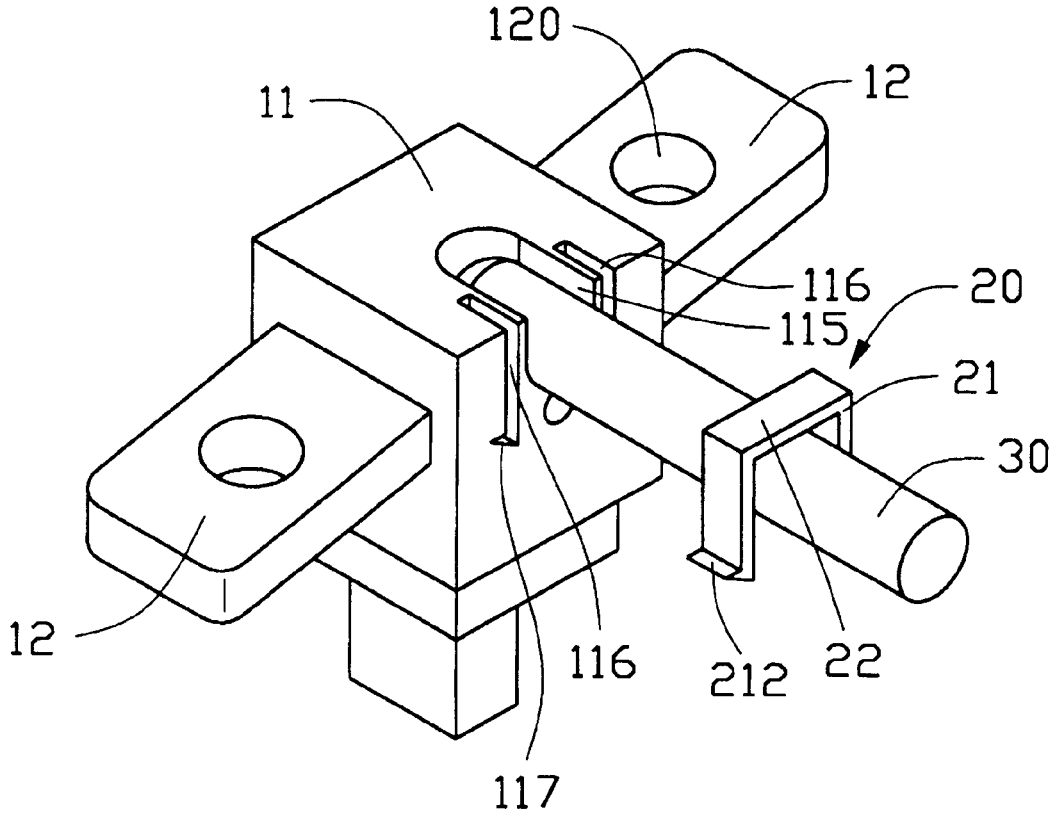
FIG. 2 is a view similar to FIG. 1, showing that the cable is bent and a fastening member is attached to the bent cable.

Also referring to FIG. 2, the fastening member 20 is unitarily formed and is substantially inverted U-shaped. The fastening member 20 includes a pair of side/vertical beams 21 substantially parallel to each other and an intermediate/horizontal beam 22 between the side beams 21 and substantially vertical to the side beams 21 for pressing against the cable 30. Each side beam 21 is used to be received in the slot 116 of the housing 11, and has a protruding triangular distal end 212 pointing away from the intermediate beam 22. The triangle distal ends 212 are used for latching within the corresponding recessed sections 117 of the housing 11. As shown in FIG. 2, the cable 30 is bent ninety degrees from the position of FIG. 1 to be received in the channel 115 and the fastening member 20 is positioned to straddle the cable 30.

The mounting wings 12 respectively depend from the side walls 113 of the housing 11 and are generally sloped in the same direction relative to the side walls 113. A hole 120 is defined in each mounting wing 12. Screws (not shown) are used to extend through the holes 120 to threadedly engage with a frame (not shown) accommodating the cable connector 10, thereby compressing the wings 12 onto the frame. Thus, the electrical cable connector 10 is fixed to the frame.

Figure 3:
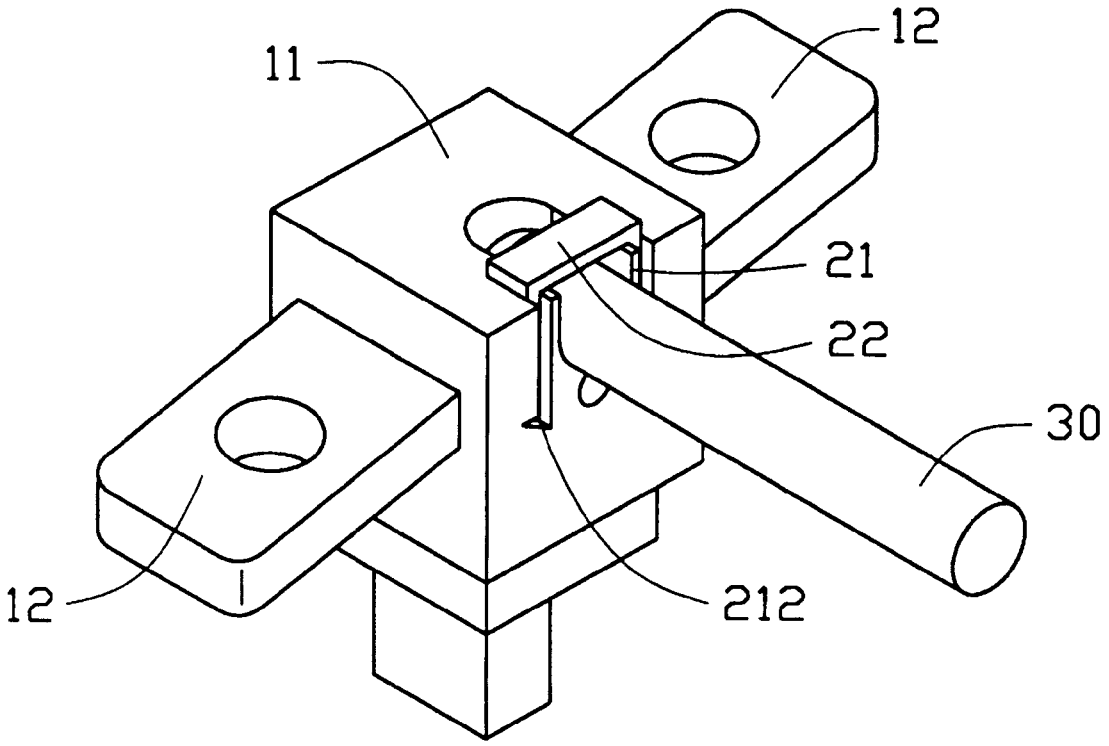
FIG. 3 is a view similar to FIG. 2 showing that the fastening member is assembled to the connector to fix the cable at the bent position.
Figure 4:
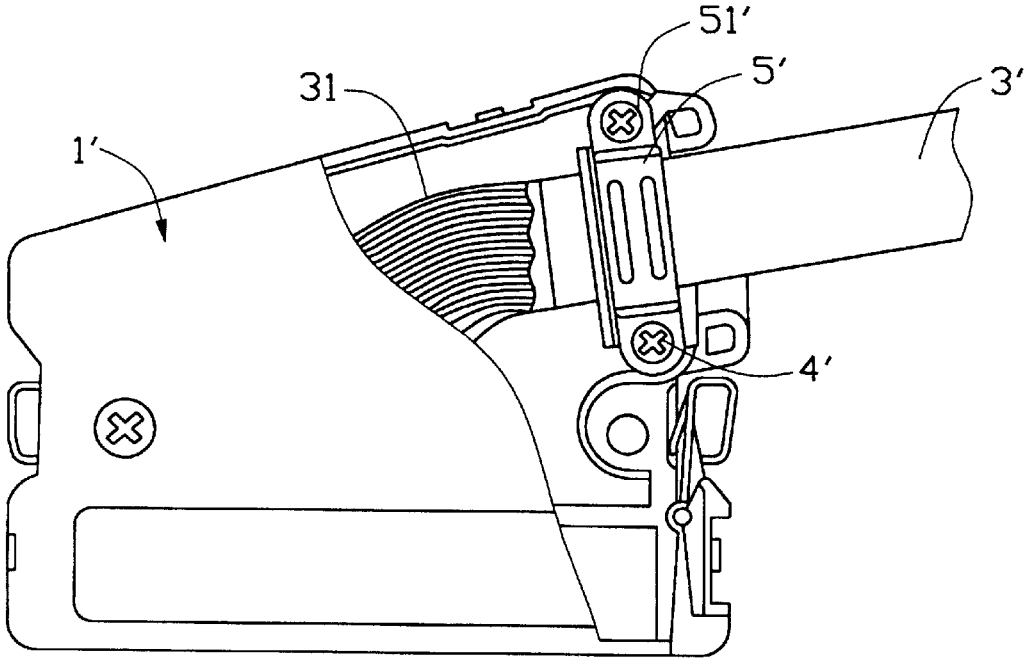
FIG. 4 (PRIOR ART)
FIG. 4 is a side elevational view of an electrical cable connector in accordance with the prior art.

To fix the cable at the bent position of FIG. 2, as shown in FIG. 3, the side beams 21 of the fastening member 20 are inserted into the slots 116 of the housing 11, the distal ends 212 of the side beams 21 are inserted into the recessed sections 117 of the housing 11, and the intermediate beam 22 presses against the cable 30 from above. As the cable 30 is received in the channel 115, movement of the cable 30 in lateral and downward directions is restrained by the housing 11. Furthermore, as the intermediate beam 22 presses against the cable 30 and the distal ends 212 of the fastening member 20 are fittingly received in the laterally extended recessed sections 117, an undesired movement of the cable 30 in upward direction can be effectively prevented by the fastening member 20. Additionally, each distal end 212 of the side beams 21 of the fastening member 20 has a triangular cross section, and each recessed section 117 of the housing 11 has a shape in conformity to a corresponding distal end 212 for facilitating reliably retaining the corresponding distal end therein. Therefore, the cable 30 is reliably retained the receiving channel 115 of the housing 11 by the fastening member 20.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable connector comprising:

a rectangular dielectric housing defining a receiving channel and a pair of slots in an upper portion of a front wall thereof, the slots being beside the receiving channel, the channel and slots depressing toward a rear wall of the dielectric housing a depth, each slot having a recessed section laterally extending from an end thereof;

a flexible cable extending into the housing and maintained at a right-angled configuration in the receiving channel of the housing of the dielectric housing;

a fastening member including a pair of side beams received in the slots of the housing from the top wall of the housing and an intermediate beam between the side beams for pressing against the cable, each side beam having a distal end pointing away from the intermediate beam and latching within a corresponding recessed section of the housing slot; and two mounting wings depending respectively from side walls of the housing.

2. The cable connector as claimed in claim 1, wherein the pair of side beams of the fastening member are substantially parallel to each other, and the intermediate beam is perpendicular to the side beams.

3. The cable connector as claimed in claim 1, wherein the distal ends of the side beams of the fastening member have substantially triangular cross sections, and the recessed sections of the housing slot have a shape in conformity to that of the distal ends for facilitating reliable retention therebetween.

4. A cable connector comprising:

a dielectric housing defining a receiving channel along a horizontal direction, at least a slot disposed beside said receiving channel, the slot extending in the same direction with the receiving channel and depressing from an upper portion of a front wall toward a rear wall of the housing;

a deflectable cable extending into the housing, an exposed portion of said cable being deflected at an angle and received within said receiving channel;

a fastening member including at least a vertical beam latchably vertically received within the slot from a top wall of the housing, and a horizontal beam integrally extending from said vertical beam and abutting against an exterior surface of the exposed portion of the cable; and a pair of mounting wings depending respectively from side walls of the housing.

5. The cable connector as claimed in claim 4, wherein the slot further includes a recessed section laterally extending at one distal end, and the vertical beam further includes at one distal end a protrusion received within said recessed section.

6. The cable connector as claimed in claim 4, wherein said receiving channel and said slot both extend through a wall of the housing which the deflected exposed portion of the cable is perpendicular to.

* * * * *